US005444818A

United States Patent [19]

Lisle

[11] Patent Number: 5,444,818

[45] Date of Patent: Aug. 22, 1995

[54] SYSTEM AND METHOD FOR DYNAMICALLY CONFIGURING SYNTHESIZERS

[75] Inventor: Ronald J. Lisle, Cedar Park, Tex.

[73] Assignee: International Business Machines Corporation, Armonk, N.Y.

[21] Appl. No.: 984,780

[22] Filed: Dec. 3, 1992

[51] Int. Cl.[6] ..... G10L 9/00

[52] U.S. Cl. ..... 395/2.67; 381/51; 395/2

[58] Field of Search ..... 381/49, 51, 46; 395/2, 395/2.1, 2.14, 2.67, 2.69, 2.73, 2.77, 2.87

[56] References Cited

U.S. PATENT DOCUMENTS

| | | | |
|---|---|---|---|
| 4,217,802 | 8/1980 | Deforeit | 84/604 |
| 4,279,186 | 7/1981 | Deforeit | 84/604 |
| 4,527,274 | 7/1985 | Gaynor | 395/2.69 |
| 4,559,602 | 12/1985 | Bates, Jr. | 395/2 |
| 4,586,905 | 5/1986 | Groff | 434/307 R |
| 4,622,877 | 11/1986 | Strong | 84/604 |
| 4,636,876 | 1/1987 | Schwartz | 360/32 |
| 4,638,709 | 1/1987 | Nagashima et al. | 84/607 |
| 4,649,783 | 3/1987 | Strong et al. | 84/606 |
| 4,677,890 | 7/1987 | Yannes | 84/661 |
| 4,682,248 | 7/1987 | Schwartz | 395/2 |
| 4,969,385 | 11/1990 | Williams et al. | 84/656 |
| 5,054,360 | 10/1991 | Lisle et al. | 84/645 |
| 5,133,010 | 7/1992 | Borth et al. | 395/2.73 |
| 5,171,930 | 12/1992 | Teaney | 381/49 |

*Primary Examiner*—Allen R. MacDonald
*Assistant Examiner*—Jariq Hafiz
*Attorney, Agent, or Firm*—Robert M. Carwell

[57] ABSTRACT

A system and method are provided for improving quality of sound generated by computerized systems having limited memory. A wavetable synthesizer is implemented wherein data utilized to synthetically generate acoustic waveforms is stored. A plurality of datasets is also generated and stored, each comprised of a digitized acoustic waveform. In response to a MIDI datastream, the system determines if an appropriate stored acoustic sample corresponding thereto resides in the system's memory. If so, the system will generate the desired sound utilizing the stored acoustic sample data. If not, the system automatically determines in real time the appropriate wavetable dataset which will generate a sound most closely approximating the acoustic sound. The system thus dynamically reconfigures in real time between wavetable and acoustic sample synthesis, being configured for the former when appropriate acoustic samples are not present.

27 Claims, 9 Drawing Sheets

SYSTEM AND METHOD FOR DYNAMICALLY CONFIGURING SYNTHESIZERS

BACKGROUND OF THE INVENTION

1. Field of the Invention

The present invention relates in general to the field of digital audio systems and, in particular, to systems which include MIDI synthesizers. Still more particularly the present invention relates to a method and apparatus for outputting digital audio and MIDI synthesized music with efficient memory utilization.

2. Description of the Related Art

MIDI, the "Musical Instrument Digital Interface" was established as a hardware and software specification which would make it possible to exchange information including musical notes, program changes, expression control, etc. between different musical instruments or other devices such as sequencers, computers, lighting controllers, mixers, etc. This ability to transmit and receive data was originally conceived for live performances, although subsequent developments have had enormous impact in recording studios, audio and video production, and composition environments.

A standard for the MIDI interface has been prepared and published as a joint effort between the MIDI Manufacturer's Association (MMA) and the Japan MIDI Standards Committee (JMSC). This standard is subject to change by agreement between JMSC and MMA and is currently published as the MIDI 1.0 Detailed Specification, Document Version 4.1, January 1989.

The hardware portion of the MIDI interface operates at 31.25 KBaud, asynchronous, with a start bit, eight data bits and a stop bit. This makes a total of ten bits for a period of 320 microseconds per serial byte. The start bit is a logical zero and the stop bit is a logical one. Bytes are transmitted by sending the least significant bit first. Data bits are transmitted in the MIDI interface by utilizing a five milliamp current loop. A logical zero is represented by the current being turned on and a logical one is represented by the current being turned off. Rise times and fall times for this current loop are less than two microseconds. A five pin DIN connector is utilized to provide a connection for this current loop with only two pins being utilized to transmit the current loop signal. Typically, an opto-isolator is utilized to provide isolation between devices which are coupled together utilizing a MIDI format.

Communication utilizing the MIDI interface is achieved through multi-byte "messages" which consist of one status byte followed by one or two data bytes. There are certain exceptions to this rule. MIDI messages are sent over any of sixteen channels which may be utilized for a variety of performance information. There are five major types of MIDI messages: Channel Voice; Channel Mode; System Common; System Real-Time; and, System Exclusive. A MIDI event is transmitted as a message and consists of one or more bytes.

A channel message in the MIDI system utilizes four bits in the status byte to address the message to one of sixteen MIDI channels and four bits to define the message. Channel messages are thereby intended for the receivers in a system whose channel number matches the channel number encoded in the status byte. An instrument may receive a MIDI message on more than one channel. The channel in which it receives its main instructions, such as which program number to be on and what mode to be in, is often referred to as its "Basic Channel." There are two basic types of channel messages, a Voice message and a Mode message. A Voice message is utilized to control an instrument's voices and Voice messages are typically sent over voice channels. A Mode message is utilized to define the instrument's response to Voice messages, Mode messages are generally sent over the instrument's Basic Channel.

System messages within the MIDI system may include Common messages, Real-Time messages, and Exclusive messages. Common messages are intended for all receivers in a system regardless of the channel that receiver is associated with. Real-Time messages are utilized for synchronization and are intended for all clock based units in a system. Real-Time messages contain status bytes only, and do not include data bytes. Real-Time messages may be sent at any time, even between bytes of a message which has a different status. Exclusive messages may contain any number of data bytes and can be terminated either by an end of exclusive or any other status byte, with the exception of Real-Time messages. An end of exclusive should is sent at the end of a system exclusive message. System exclusive messages always include a manufacturer's identification code. If a receiver does not recognize the identification code it will ignore the following data.

As those skilled in the art will appreciate upon reference to the foregoing, musical compositions may be encoded utilizing the MIDI standard and stored and/or transmitted utilizing substantially less data. The MIDI standard permits the use of a serial listing of program status messages and channel messages, such as "note on" and "note off" as control messages.

When utilized in conjunction with various MIDI-controlled sound generated devices or modules, musical compositions may be recorded and played.

As will hereinafter be detailed, these sound generators or "modules" have taken many forms. In one form, referred to as "wavetable" or subtractive synthesis, stored wave forms (shorter than an entire sampled sound discussed below) are operated upon by filters, voltage controlled amplifiers, and the like to generate or "synthesize" sound. One benefit of this approach in addition to creating new and unusual sound forms not present in nature was that relatively little memory was required, which, in low-end computer systems, can be an extremely precious commodity.

Yet another form of sound generation took the form of sampling, digitizing, and storing an analog acoustic signal, and then subsequently converting it back to analog form during playback. A distinct advantage to this approach was that it frequently could emulate complex acoustic wave forms in a far more realistic and convincing manner than other techniques known in the art. However there was a price to be paid for such realism. The data rate required for such simple sampling systems can be quite enormous with several tens of thousands of bits of data and associated memory being required for each second of audio signal.

As a consequence, many different encoding systems have been developed to decrease the amount of data required in such systems. For example, many modern digital audio systems utilize pulse code modulation (PCM) which employs a variation of a digital signal to represent analog information. Such systems may utilize pulse amplitude modulation (PAM), pulse duration modulation (PDM) or pulse position modulation (PPM) to represent variations in an analog signal.

One variation of pulse code modulation, Delta Pulse Code Modulation (DPCM) achieves still further data compression by encoding only the difference between one sample and the next sample. Thus, despite the fact that an analog signal may have a substantial dynamic range, if the sampling rate is sufficiently high so that adjacent signals do not differ greatly, encoding only the difference between two adjacent signals can save substantial data. Further, adaptive or predictive techniques are often utilized to further decrease the amount of data necessary to represent an analog signal by attempting to predict the value of a signal based upon a weighted sum of previous signals or by some similar algorithm.

In each of these digital audio techniques speech or an audio signal may be sampled and digitized utilizing straightforward processing and digital-to-analog or analog-to-digital conversion techniques to store or recreate the signal.

While the aforementioned digital audio systems may be utilized to accurately store speech or other audio signal samples, even with data compression the substantial penalty in storage requirements must be paid as compared with those required in MIDI-controlled synthesized systems described above. However, in systems where it is desired to recreate realistic human speech or other acoustic sounds, there often exists no appropriate alternative.

Several hybrid approaches were attempted in the prior art seeking to obtain the benefits of synthesized sound such as wave table synthesis and sampled sound hereinbefore discussed. In one such attempt, a parallel implementation of both wavetable synthesis and sampled sounds was provided in hardware, a representative example being the SY77 Synthesizer manufactured by the Yamaha Corporation. Such a synthesizer provided for switching between wavetable or sample-generated sounds and in some limited instances cross-connection between features of each (such as using the VFO of the wavetable synthesizer with a playback of a sampled sound). While thus providing the benefits of both sampled and wavetable synthesis, the obvious limitation of this parallel implementation was the requirement of dual parallel implementations having attendant cost increases.

In still another attempt to provide a hybrid approach offering benefits of wavetable and sampled synthesis, referred to in the art as "LA" synthesis and as implemented representatively by various synthesizers manufactured by the Roland Corporation, the generated waveform was a combination of a sampled and wavetable-generated waveform. It has been found psychoacoustically that much of the character of a sound is identified in the human ear by the information carried in the attack portion of a waveform. Accordingly, in accordance with this technique, a first attack portion of a waveform was generated by means of playback of an actual sampled attack of the desired instrument, thereby lending the necessary realism to the implementation of the sound. This was of course at the cost of memory in that as previously discussed such sampled waveforms, for any reasonable resolution and signal to noise ratios, requires relatively more memory than a corresponding sound genesis technique utilizing synthesis such as wavetable synthesis. Nevertheless, because only the attack portion of the sound was generated by an actual sampled sound, memory was saved which would otherwise have to be used if the entire waveform was a sample playback. The remaining portion of the desired waveform was thence generated by means of the second technique, namely wavetable synthesis which provided more or less the sustained or steady state portion of the desired waveform. Inasmuch as this portion was generated by wavetable synthesis with less severe memory requirements than would otherwise be necessary if this portion of the waveform was generated by a storage sample, savings in memory was thereby realized. Although there were distinct benefits to this hybrid approach such as the ability to generate new sounds which were combinations of sampled and wavetable generated artificial sounds, they were nevertheless serious drawbacks to this approach as well.

First, provision was not made for selecting either or the other modes of sound generation for generating the entirety of the sound. One reason, of course, was that this would defeat the purpose of such a hybrid approach inasmuch as for the sampling case, for example, it would require storage not only of just the attack portion of the sampled waveform but the rest of the waveform (for which the whole approach was directed to saving the memory otherwise necessary to create this portion). Yet another serious drawback to this approach was that there was no provision made for uploading, altering, or otherwise upgrading the sounds by way of altering and adding to the existing sample portions and wavetable parameters.

In yet another attempt to avoid the problems of the aforementioned approaches requiring dual hardware, limitations in upgrading new sounds or providing for a complete sampled or wavetable sound implementation if desired, development also focused on digital signal processor or DSP sound generation. In such an approach, wherein the DSP could implement the sound generation, attempts have been made to reconfigure the DSP dynamically to generate either sampled or synthesized sound as desired. In such an implementation, particularly wherein an expensive multi-tasking DSP system was not provided, it was found necessary to load DSP code implementing either the wavetable or sample-based sound generation, on the fly as well as requiring switching between these various forms of code dynamically in determining based upon the incoming MIDI datastream which mode in the DSP to be switching to.

Such a system was found to be extremely difficult to implement, one alternative being to provide multiple copies of DSP code simultaneously available depending upon the mode desired. The problems with the approach of dynamically loading DSP code, depending upon the sound-generation technique desired, was compounded in multi-tasking operating systems since it was difficult if not impossible to know, due to the ongoing task switching, when the appropriate time was and how to coordinate the loading and switching of the DSP code, again resulting in a need to load complete sets of DSP code and permit the multi-tasking system to perform the switching.

Multimedia is an emerging market wherein MIDI capability is a key multimedia element. However, as previously noted, a serious problem for low-end systems which may become prevalent in homes and school environments is in maintaining low cost of the system which characteristically results in relatively small memory systems, giving rise to the aforementioned problems. As the use of MIDI increases as well, it is likely to further increase adoption by low-end users where equipment expenditures in this area are extremely limited. Thus, techniques are highly sought which will provide for multimedia function to operate on smaller, less expensive systems such as techniques for saving memory. Such memory costs in low-end systems may be the critical difference in successfully providing systems in the high volume, low price market. Specifically, a means was needed to provide for MIDI, including sampled sounds on limited hardware while nevertheless providing the highest quality sound possible within these constraints of low price systems.

It was thus apparent that a need existed for a method and apparatus whereby certain digitized audio samples, such as human speech and acoustical musical sounds, could be recreated and combined with synthesized music utilizing s MIDI data file in such a way as to obtain the benefits of both approaches, while at the same time accounting for these severe limitations imposed on memory availability by low end systems.

More particularly, it was found highly desirable to provide a single hardware configuration implementing multiple modes of sound generation, and in particular, either synthesized (such as wavetable) sounds or sampled sound generation. Still further, it was found desirable to provide for such a system which would not require dynamic reloading of code such as DSP code and which would not require inordinate time to be spent trying to determine which modules of DSP code to execute. Yet a further object was to provide a system providing the benefits of both synthesized and sampled sounds wherein it was nevertheless possible to upgrade the system with improved synthesized and sampled sounds. Still further, it was desired to implement the system wherein a basic set of acceptable sounds was provided (such as the standard 175 general MIDI implementation sounds) implemented with a reasonably cost effective yet pleasing system such as wavetable synthesis, and wherein, if desired, the user might nevertheless upgrade the quality of these sounds to sampled sounds which could be automatically substituted for the corresponding general MIDI wavetable synthesized sounds if available as desired and as the system resources permitted.

These and other benefits are provided by the invention which will best be understood by reference to the following detailed description of an illustrative embodiment when read in conjunction with the accompanying drawings wherein:

SUMMARY OF THE INVENTION

A system and method are provided for improving quality of sound generated by computerized systems having limited memory. A wavetable synthesizer is implemented wherein data utilized to synthetically generate acoustic waveforms is stored. A plurality of datasets is also generated and stored, each comprised of a digitized acoustic waveform. In response to a MIDI datastream, the system determines if an appropriate stored acoustic sample corresponding thereto resides in the system's memory. If so, the system will generate the desired sound utilizing the stored acoustic sample data. If not, the system automatically determines in real time the appropriate wavetable dataset which will generate a sound most closely approximating the acoustic sound. The system thus dynamically reconfigures in real time between wavetable and acoustic sample synthesis, being configured for the former when appropriate acoustic samples are not present.

DETAILED DESCRIPTION OF THE PREFERRED EMBODIMENT

Figure 1:
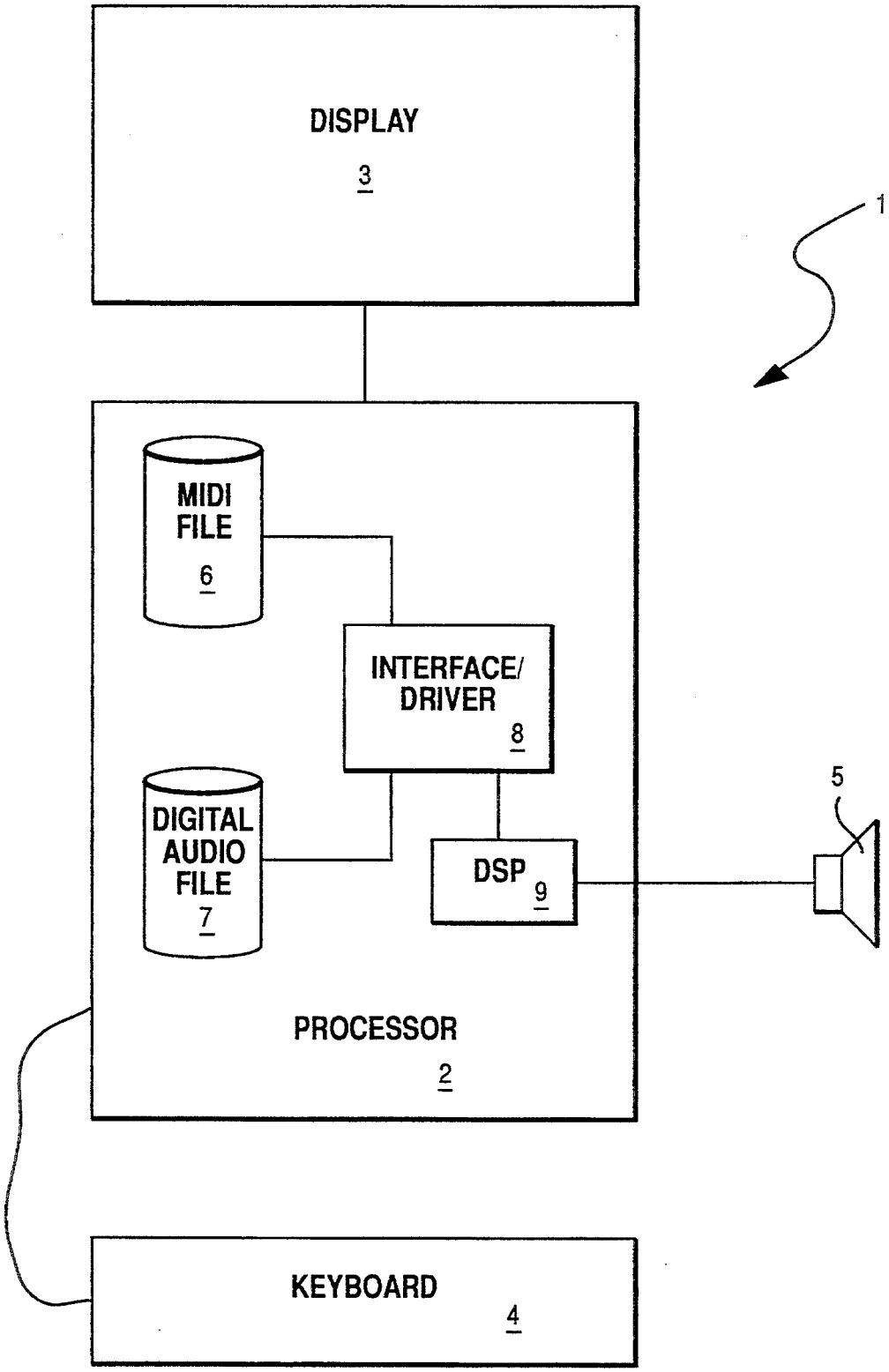
FIG. 1 is a block diagram of a computer system which may be utilized to implement the method and apparatus of the present invention.

With reference now to the figures and in particular with reference to FIG. 1, there is depicted a block diagram of a computer system 1 which may be utilized to implement the method and apparatus of the present invention. Related technology for implementing the invention regarding sampling, MIDI, DSP and the like may be found in patent application Ser. Nos. 07/608,111; 07/608,105; 07/608,126; and 07/770,494 which are incorporated herein by reference. As is illustrated, a computer system 1 is depicted which will implement a dynamically configurable synthesizer generating wavetable synthesized as well as sampled acoustic sound, preferably under MIDI control, in accordance with the teachings of the invention. Computer system 1 may be implemented utilizing any state-of-the-art digital computer system having a suitable digital signal processor disposed therein which is capable of implementing a MIDI synthesizer. For example, computer system 1 may be implemented utilizing an IBM PS/2 type computer which includes an IBM Audio Capture & Playback Adapter (ACPA).

Also included within computer system 1 is display 3. Display 3 may be utilized, as those skilled in the art will appreciate, to display those command and control features typically utilized in the processing of audio signals within a digital computer system. Also coupled to computer system 1 is computer keyboard 4 which may be utilized to enter data and select various files stored within computer system 1 in a manner well known in the art. Of course, those skilled in the art will appreciate that a graphical pointing device, such as a mouse or light pen, may also be utilized to enter commands or select appropriate files within computer system 1.

Still referring to computer system 1, it may be seen that processor 2 is depicted. Processor 2 is preferably the central processing unit for computer system 1 and, in the depicted embodiment of the present invention, preferably includes an audio adapter capable of implementing a MIDI synthesizer by utilizing a digital signal processor. One example of such a device is the IBM Audio Capture & Playback Adapter (ACPA).

As is illustrated, MIDI file 6 and digital audio file 7 are both depicted as stored within memory within processor 2. The output of each file may then be coupled to interface/driver circuitry 8. Interface/driver circuitry 8 is preferably implemented utilizing any suitable audio application programming interface which permits the accessing of MIDI protocol files or digital audio files and the coupling of those files to an appropriate device driver circuit within interface/driver circuitry 8.

Thereafter, the output of interface/driver circuitry 8 is coupled to digital signal processor 9. Digital signal processor 9, in a manner which will be explained in greater detail herein, is utilized to output digital audio and MIDI synthesized music and to couple that output to audio output device 5. Audio output device 5 is preferably an audio speaker or pair of speakers in the case of stereo music files.

Figure 2:
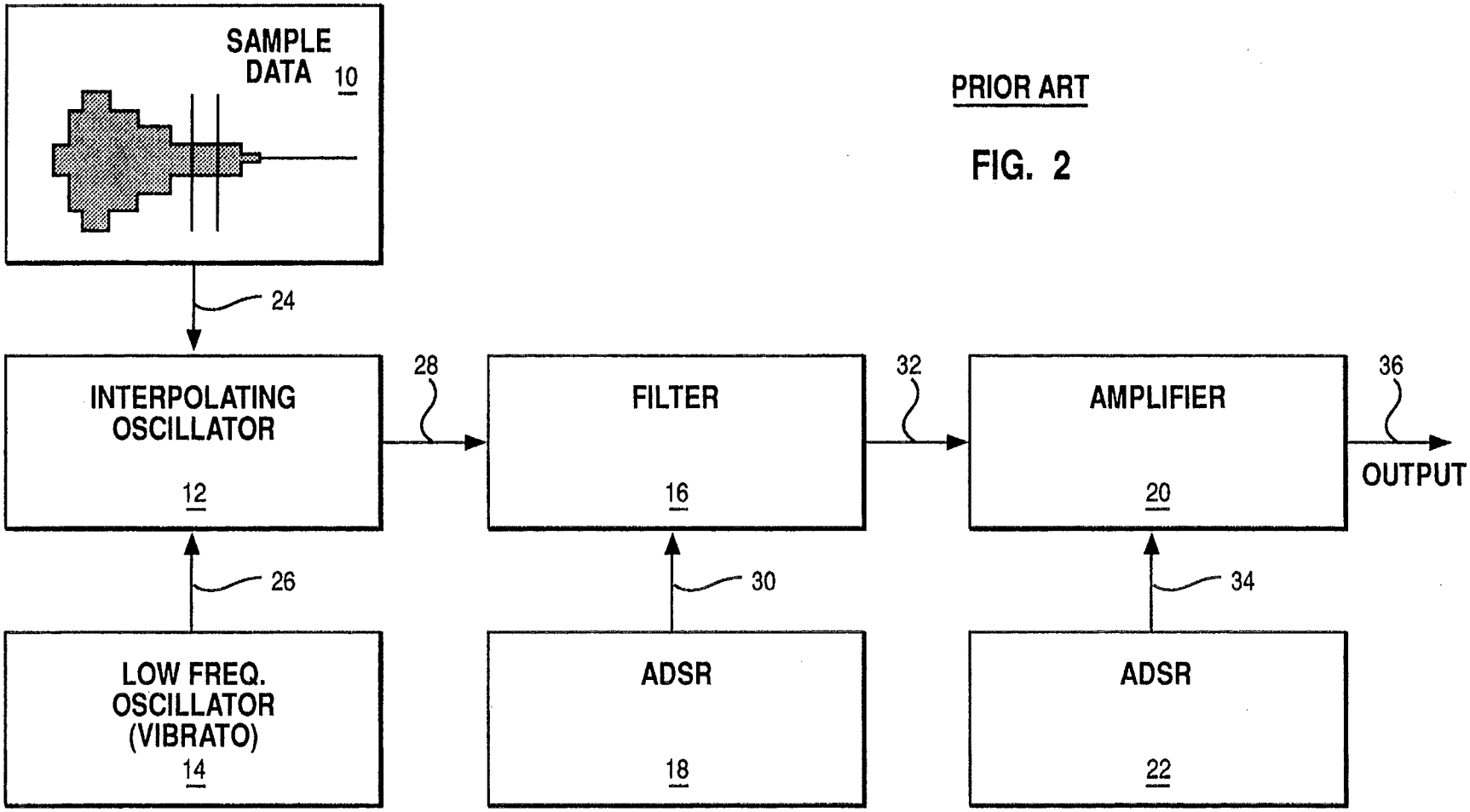
PRIOR ART FIG. 2
FIG. 2 is a block diagram illustrating the prior system of sampling synthesis.

Turning now to FIG. 2, in order to more fully comprehend the invention it will be helpful to describe a technique referred to as sampling synthesis utilized in the music synthesizer art today in order to generate sounds of existing (as well as non-existent) musical instruments. Depicted in FIG. 2 is a functional block diagram of such an instrument. In the simplest case, an existing instrument is "tape recorded" in the sense that a single note is played from the instrument, and that note is subsequently digitized for storage in digital memory, shown as sample data 10. Playback of that sound by a "sampler" device is performed in a manner analogous to playing back the original tape. Many instruments sounds have variable length durations. The clarinet, for example, will continue to sound as long as the musician continues to blow into the mouthpiece. This is in contrast, for example, to a drum, whose sound quickly dies out at a fairly constant rate after being struck. A sampler allows notes of different lengths to be generated using a technique known as looping. A section of the digitized waveform is played back repeatedly, thus giving the impression of continuous data. Various functions may be implemented in analog circuitry or in the digital domain to enhance the sound. For example a low frequency oscillator 14 may be provided with an output signal 26 which operates upon the sample data output 24 to modulate the sound from playing back the samples in a desired manner to create a vibrato. The interpolating oscillator 12 receiving the sample data output 24 and vibrato data 26 operates upon this data to produce a vibrato modulated audio signal of the desired average pitch.

Still referring to FIG. 2, yet another technique for enhancing the played-back sample data commonly used in samplers is filtering. A filter is utilized to change the tonal quality of the digitized waveform. This is effective in producing the types of changes that occur to sounds that a musical instrument will make when played at different volumes. Generally speaking, for example, a musical instrument will generate a brighter sound when played loudly. A filter may therefore be utilized to remove some of the brightness from a waveform when being played quietly. In the block diagram of a typical sampler in FIG. 2, such a filter 16 is thereby provided which operates on the output of the interpolating oscillator 28 to generate a filter output 32.

Yet another desired capability of such a sampler is to control the amplitude of the resulting output 36. This may be conveniently effected by means of an amplifier 20 receiving the output of the filter 32, whereby the amplifier, after operating upon the filter output 32 generates the desired output 36. It will appreciated that in a manner well known in the art it has been found convenient to regulate operation of such filters 16 and amplifiers 20 by means of voltage control, and consequently ADSR generators 18 and 22 may typically be provided having respective outputs 30 and 34 that operate upon their respective filter 16 or amplifier 20. Such an ADSR generator will be easily recognized in the art as being an attack, decay, sustain, and release generator providing an envelope comprised, in sequence, of such an attack, decay, sustain, and release value defining the envelope which will be a voltage value whose magnitude regulates the amount of filtering or amplification provided.

A shortcoming of the foregoing sampler technique just described is that it requires large amounts of memory 10 to store each digitized sound, even if techniques are employed in an attempt to reduce the requirements of such memory such as the looping technique previously mentioned wherein to obtain a sustained sound the same data is read out over and over and converted into sound rather than having to capture and digitize the entire duration of the desired sound. In an environment such as a synthesizer implemented utilizing a DSP attached to a personal computer, it may not be possible to guarantee that a given amount of such memory 10 will be available for the storage of musical instrument digital waveforms, e.g. "samples". The previously mentioned General MIDI Mode standard nevertheless requires that a base set of 175 musical instruments and special effects sounds be available. This obviously poses a problem if there isn't enough such memory 10 available to hold the samples for all 175 sounds.

Figure 3:
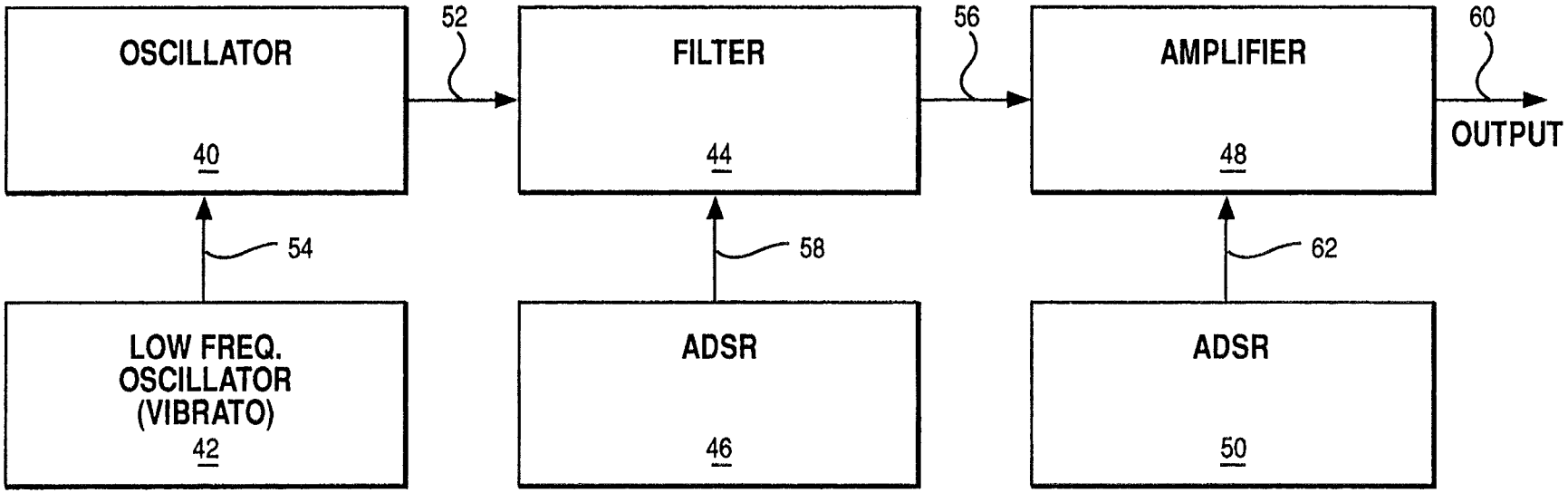
PRIOR ART FIG. 3
FIG. 3 is a block diagram illustrating the prior art system of subtractive synthesis.

Turning now to FIG. 3, yet an additional technique of sound generation known in the prior art should be understood to gain a comprehensive understanding of the invention. FIG. 3 is a simplified block diagram of yet another type of synthesizer known in the art referred to as a subtractive synthesizer, such subtractive synthesis being popularized during the mid-1970's as for example in the well known Moog synthesizer. This type of synthesizer utilizes an oscillator 40 to generate a continuous fixed periodic waveform shown as oscillator output 52. As in the case of the sampling synthesis of FIG. 2, a low frequency oscillator 42 may be provided for similar reasons having an output 54 modulating the oscillator 40 to provide a modulated output 52 including vibrato as desired. Also similar to the sampling synthesis technique illustrated in FIG. 2, a filter 44 may be provided to modify the harmonic content of the oscillator output 52 in response to an ADSR generator 46 output 58. The output 56 of the filter containing the output of the oscillator 52 having its harmonic content modified by the ADSR generator 46, will then preferably be delivered to a voltage controlled amplifier 48 in the manner of the synthesizer depicted in FIG. 2 whereby the envelope of the signal may thereby be shaped by the operation of a second ADSR generator 50, whose output 62 regulates the amount of amplification by the amplified 48 utilized to generate the output 60.

Figure 4:
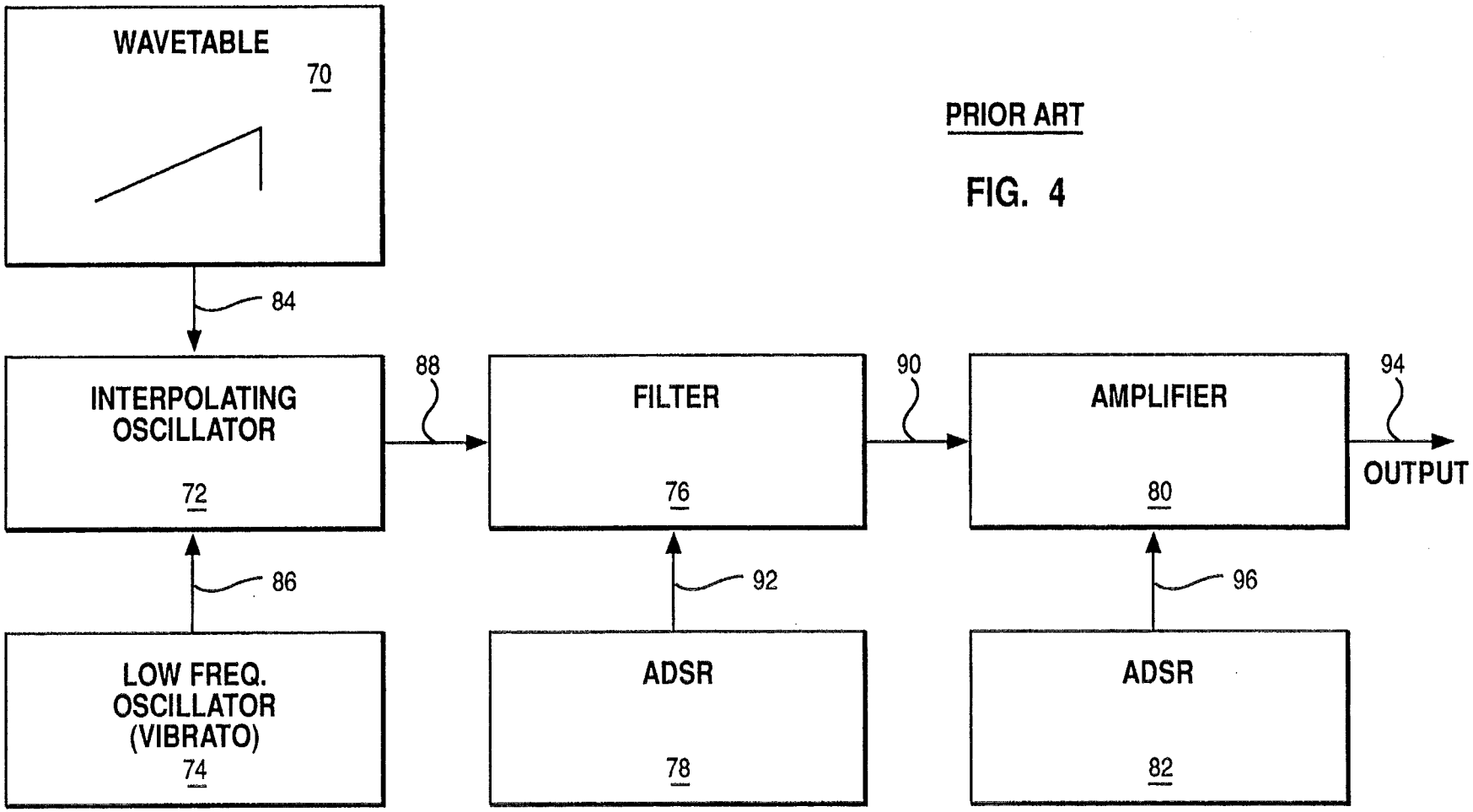
PRIOR ART FIG. 4
FIG. 4 is a block diagram illustrating the prior art system of wavetable synthesis.

Yet a third form of sound generation should be understood in gaining an appreciation of the subject invention known as wavetable synthesis. A wavetable synthesizer, which is a derivative of the subtractive synthesizer of FIG. 2 may be shown depicted in a functional block diagram in FIG. 4. This form of synthesizer will be recognized as being quite similar to that of FIG. 3. More particularly, an interpolating oscillator 72 is provided which operates upon sound data 84 in response to a vibrato output 86 from a low frequency oscillator 74, resulting in a modulated output 88 delivered to a filter 76. In a typical embodiment this filter 76 in turn operates on the oscillator output 88 in response to a control signal 92 from an ADSR 78, the resulting filter output 90 thereafter being delivered to a voltage controlled amplified 80. Also in like manner to the previously described synthesizer techniques, a second ADSR generator 82 is provided having a voltage control signal output 96 controlling the magnitude of amplification of the amplifier 80 and thus the output 94. A comparison of FIGS. 3 and 4, however, reveals the difference between such subtractive synthesis and wavetable synthesis. In the wavetable synthesis of FIG. 4, rather than a continuous fixed periodic waveform generated by the oscillator 40 of the subtractive synthesize in FIG. 3, this continuous fixed periodic waveform is generated from a lookup wavetable 70, whose output 84 generates the desired fixed periodic waveform in a manner well known in the art.

Figure 5:
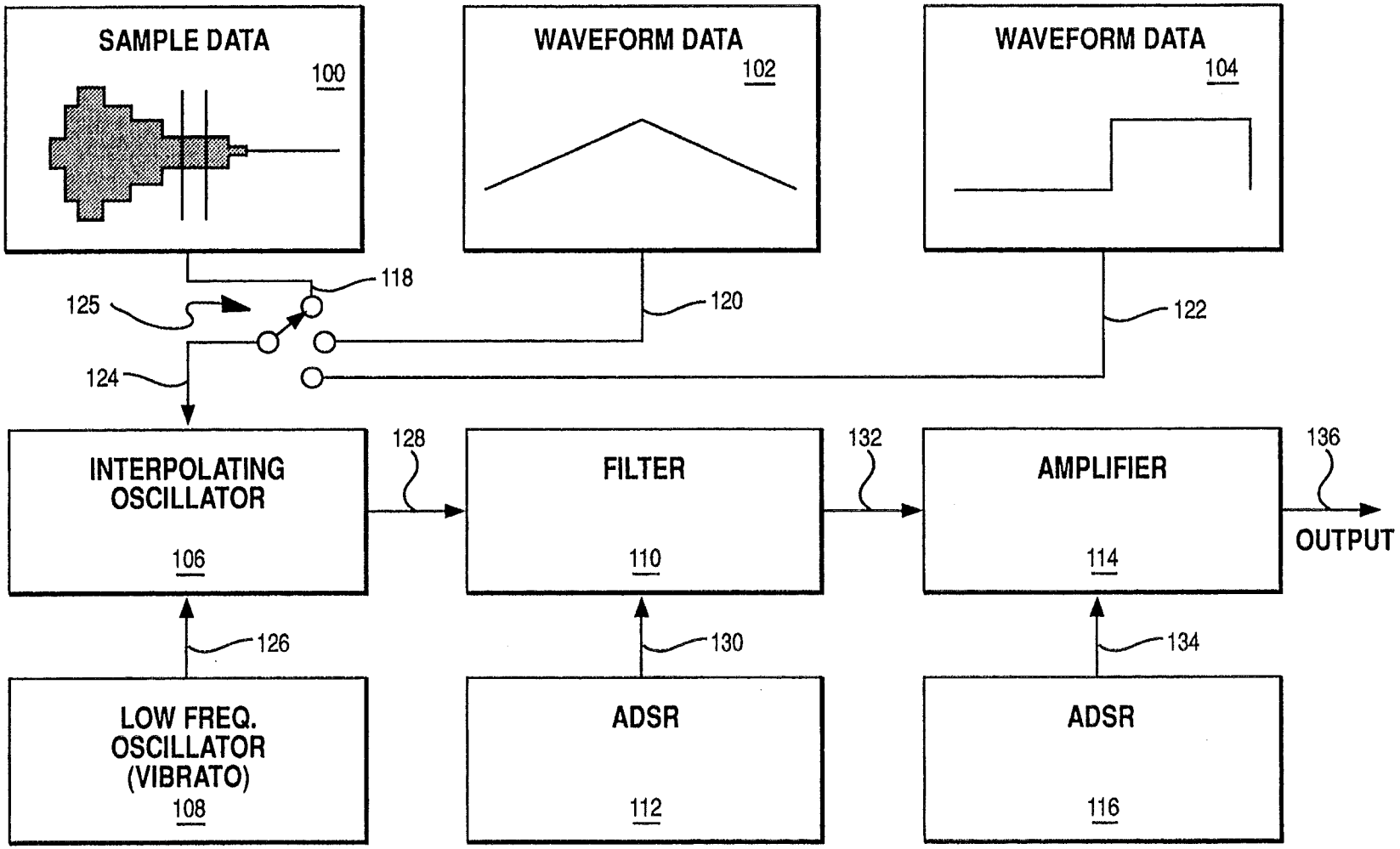
FIG. 5 is a block diagram of a dynamically configuring synthesis method and apparatus in accordance with the present invention.

Turning now to FIG. 5, as previously described, it is a feature of the invention to provide for a system and method for performing the previously described several types of music synthesis within a single sound generation configuration depicted in FIG. 5. As described herein, this allows implementing a full array of musical instrument sounds regardless of the amount of sample memory that is available. More particularly, the invention provides a solution to the aforementioned problem with samplers in having such memory-intensive requirements in that the system and method described herein provides implementation of a synthesizer that can utilize sampling if possible, but which is nevertheless capable of synthesizing a musical instrument sound if a sample is not available due to insufficient memory available to load the sample into memory for example. In other words, in one embodiment of the subject invention, the sampling synthesis depicted in FIG. 2 is effectively combined with the subtractive synthesis of FIG. 3 and, more particularly, a wavetable synthesis of FIG. 4, resulting in the configuration shown in FIG. 5. Subtractive synthesis, it will be noted, is improved in wavetable synthesis. As will be hereinafter detailed, when a musical instrument is to be synthesized, if its sample data is available it will be utilized. Alternatively, however, the wavetable parameters may be utilized to construct the sound.

Figure 9:
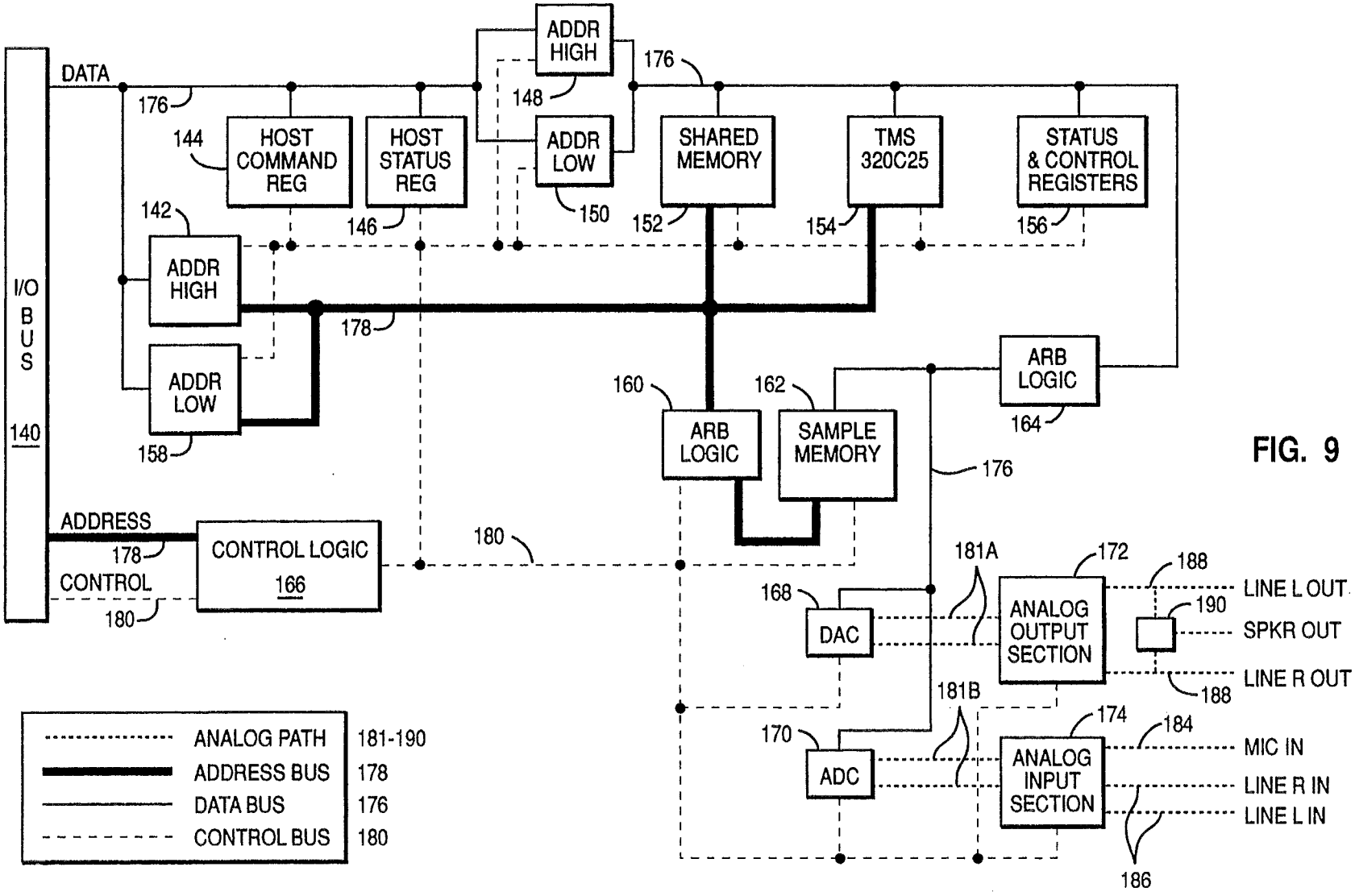
FIG. 9 is a block diagram of a portion of a computer system of FIG. 1 used in implementing the method and apparatus of the present invention, including an audio adapter having a digital signal processor and digital-to-audio and audio-to-digital converters.

Turning now to FIG. 5 in more detail, the dynamic synthesizer of the present invention will be seen depicted therein in functional block diagram form which may be implemented by the system shown in FIG. 1 and FIG. 9 in more detail. Several similarities will be recognized in the system of FIG. 5 with those previously described. Specifically, as in the case of the sampling synthesis of FIG. 2, an interpolating oscillator 106, low frequency oscillator 108, filter 110, amplifier 114, and ADSR generators 112 and 116 are provided for similar reasons to those described with reference to FIG. 2. Each of these functional blocks of course have their respective outputs 126–136. Similarly, a storage 100 for sample data is provided as well as storage for waveform data or parameters, a plurality of which may be seen depicted as waveform data storage 102 and 104. Functionally and conceptually, it will be appreciated that in a manner to be described in greater detail, if some form of electronic or digital implementation of a fast switch were provided, a sound could be generated by either deriving sample data from the sample data storage 100 or waveform parameters from the waveform data storages 102, 104, etc. whereby the sound would be generated based upon either the sample data or the waveform data. Such a switching function shown conceptually as switch 125 is provided in the dynamic synthesizer of FIG. 5 having an output 124 which may alternatively either be the sample data or waveform data delivered to the interpolating oscillator for conversion into sound. The "switch" being multipositional, may be caused in software to "rotate" so as to selectively retrieve on lines 118, 120, 122, etc. respective sample data or waveform data from the sample data storage 100 or waveform data storage 102, 104, respectively. It will be appreciated that the block diagram of the dynamic synthesizer of the present invention depicted in FIG. 5 is functional and conceptual in nature. For example, the switch 125 is intended only schematically to indicate that the system 1 will provide alternatively for the address of either of the hardcoded waveform data 102 and 104, or the address of a large portion of memory containing sample data 100 allocated from system memory at the time that the sample data was load, ed.

Figure 6:
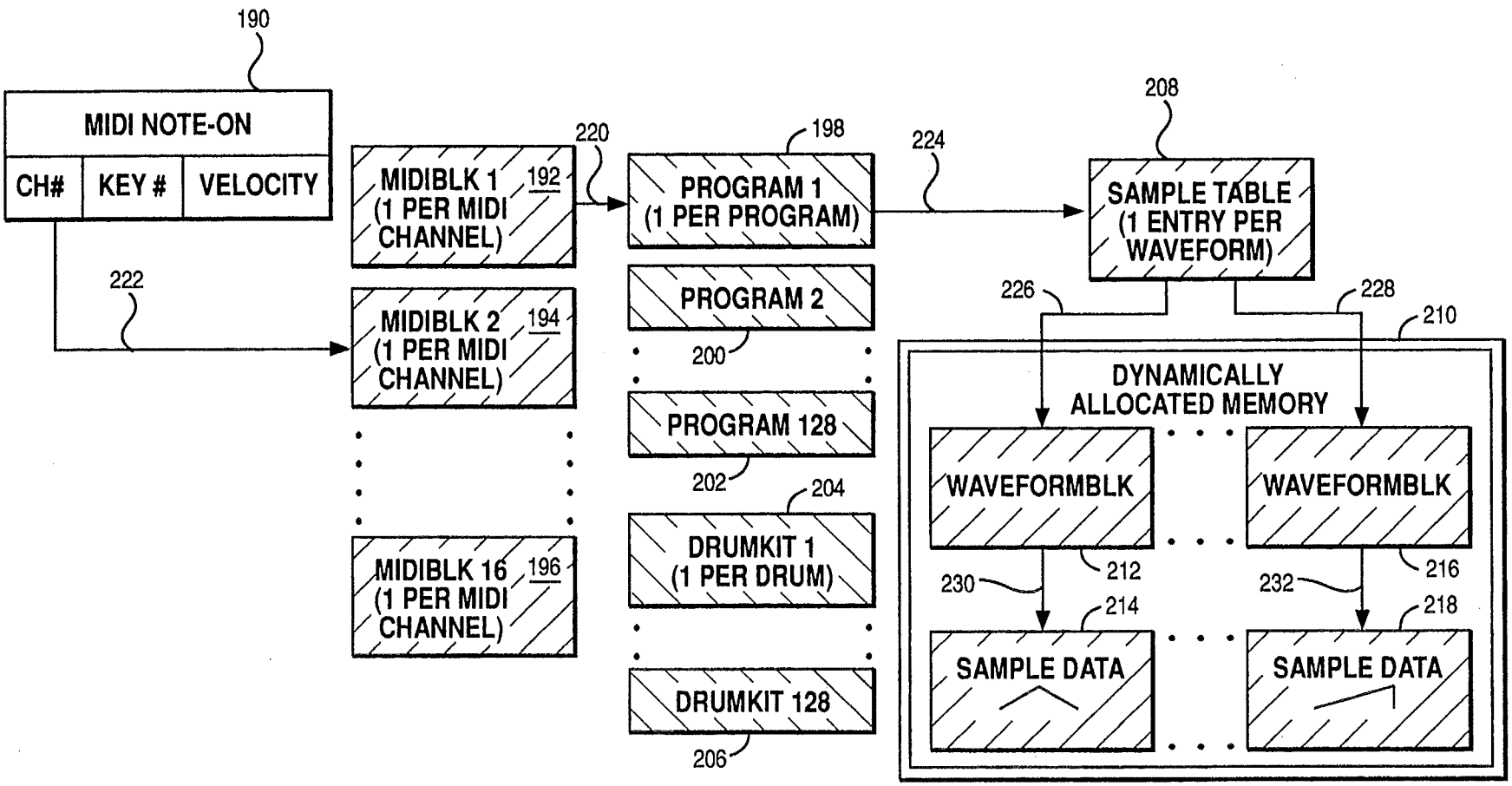
FIG. 6 is a block diagram of control structures used in the conversion of MIDI events to the selection of voicing parameters and waveforms or samples.
Figure 7:
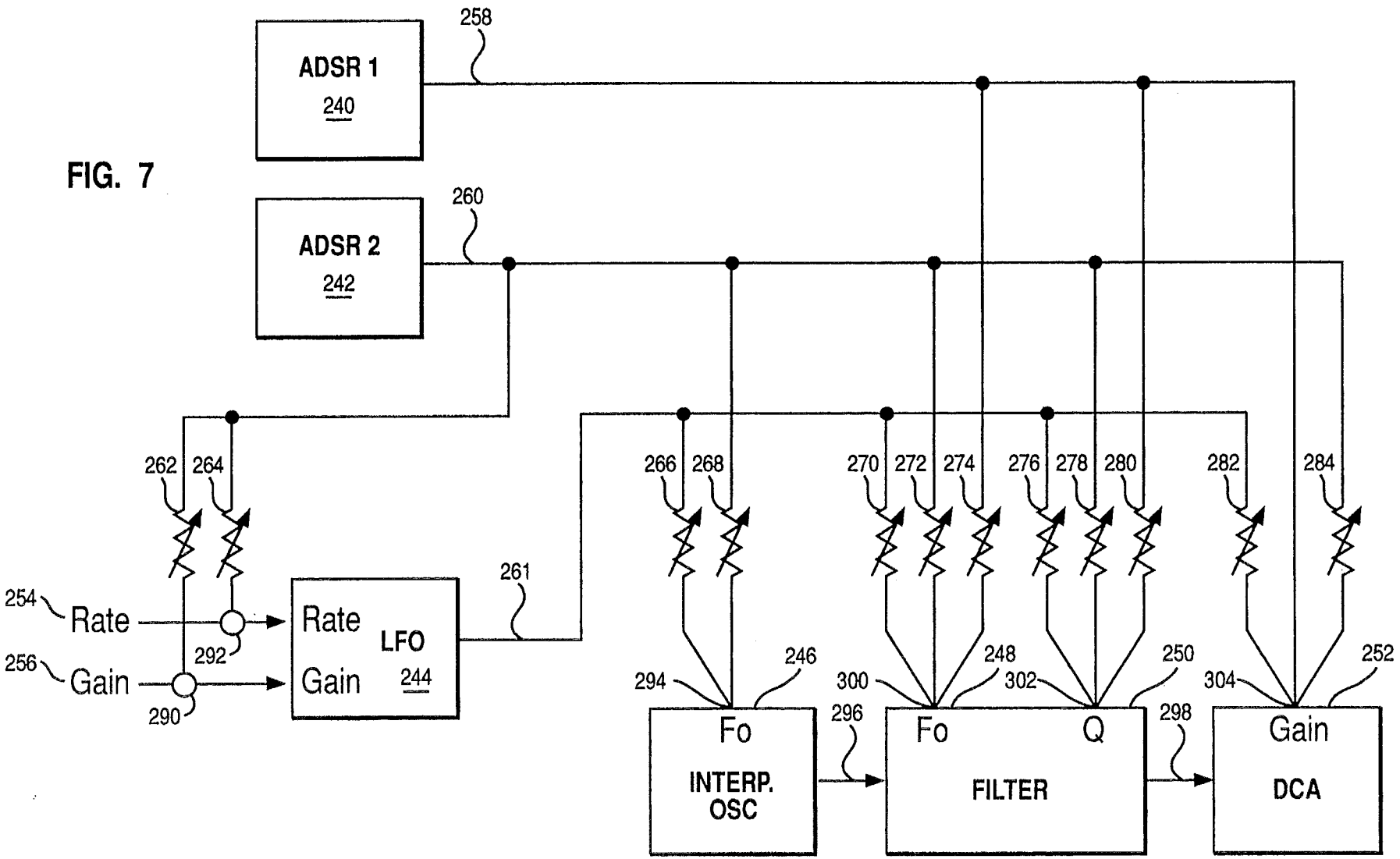
FIG. 7 is a block diagram illustrating how the ADSRs and LFO are commonly shared between the oscillator, filter, and digitally controlled amplified (DCA).

Turning now to FIG. 6 there is yet another more detailed functional block diagram of the system of the invention for providing dynamic synthesis. MIDIBLKs 192, 194, and 196 are used to maintain information regarding the status of MIDI Channels, specifically including currently selected program change number, pitch bend, and volume. When a Note-On MIDI event 190 for a particular MIDI channel is received, the program change number from the MIDIBLK 192, 194, or 196 for that MIDI channel (222) is used to select with command 220 a PROGRAM 198 through 202. In the case of MIDI Channel 10, the Note-On key number 190 is used directly to select a DRUMKIT block 204 through 206. Those skilled in the art will appreciate that MIDI channel 10 is used for the drum kit, in such manner that the Note-On key number designates the specific drum sound to produce. Each PROGRAM block 198 through 206 contains all the synthesizer parameters needed to control the synthesizer (as depicted in FIG. 7). In addition, it contains an index or pointer 224 into the Sample Table 208. The Sample Table 208 contains pointers 226 228 to WAVEFORMBLKs 212 216 for each set of Sample Data 214 218 loaded into the system. The WAVEFORMBLKs 212, 216 contain information about the waveforms or samples 214, 218 such as location, length, loop points, and loop type. Initially, the system may contain voice data 198–206 which utilizes only simple predefined waveforms 212–218, requiring a minimum of system memory 210. As the user loads additional samples into the system, additional entries are created in the Sample Table 208, pointing to new WAVEFORMBLKs 212, 216 which point 230, 232 to dynamically allocated memory into which the sample data is copied 214, 218. In addition, the PROGRAM 198–206 associated with the newly loaded sample data is updated to reference 224 the newly created Sample Table entry 208.

Turning now to FIG. 7, there is depicted therein a functional block diagram illustrating the synthesizer engine used to translate the control information referred to in FIG. 6 into sound. This engine utilizes common synthesizer elements as described in FIGS. 2, 3, and 4, and implements the lower 6 blocks of FIG. 6. In the preferred embodiment of the invention, FIG. 6 would be implemented using host system programming to execute on the processor 2 of FIG. 1, while the elements shown on FIG. 7 are implemented on the DSP 9 of FIG. 1. Notice that none of the elements appearing in FIG. 7 require any change whatsoever in order to perform either sampling or wavetable synthesis. That control is performed strictly in the logic illustrated in FIG. 6, and thus requires no reconfiguration of the DSP elements in FIG. 7. In addition, this figure illustrates that the control signals 258, 260, 261 generated by the ADSRs 240, 242 and the Low Frequency Oscillator (LFO) 244, respectively, are controlled and routed to each of the audio processing blocks 246, 248, 252.

A rate and gain signal 254, 256 may be utilized to control the rate and gain of the LFO 244. An output of an ADSR 260, may also be utilized to adjust the magnitude of these rate and gain signals, shown conceptually by attenuators 262 and 264 under control of the output 260 of the ADSR 242. Moreover it will be appreciated that the precise value of the center frequencies $F_0$ 294 and 300 of oscillator 246 and 248 may be controlled by the magnitude of the control signals 258, 260, and 261. Accordingly, this is shown functionally by provision of attenuators 266-274 intending to indicate variable control of the center frequencies 294 and 300 of the respective oscillator 246 and 248 by the ADSRs and LFO 240–244. In like manner, it is conventional for the Q 302 of the filter 250 and gain 304 of the DCA 252 to be controlled by the magnitude of a parameter from ADSRs and/or LFO 240–244. Thus conceptually the variable attentuators 276–284 are shown in FIG. 7 under control of a respective ADSR or LFO providing this variable Q signal 302 or gain signal 304 to control the Q or gain of the filter or DCA 250, 252 respectively. Connections 296 between oscillator 246 and filter 250 and 298 between filter 250 and 252 are also shown to indicate that the oscillator output 296 is operator upon in a desired manner by the filter 250 and tile resulting output of the filter, 298, thereupon has its amplitude modified by the controllable amplifier 252.

Figure 8:
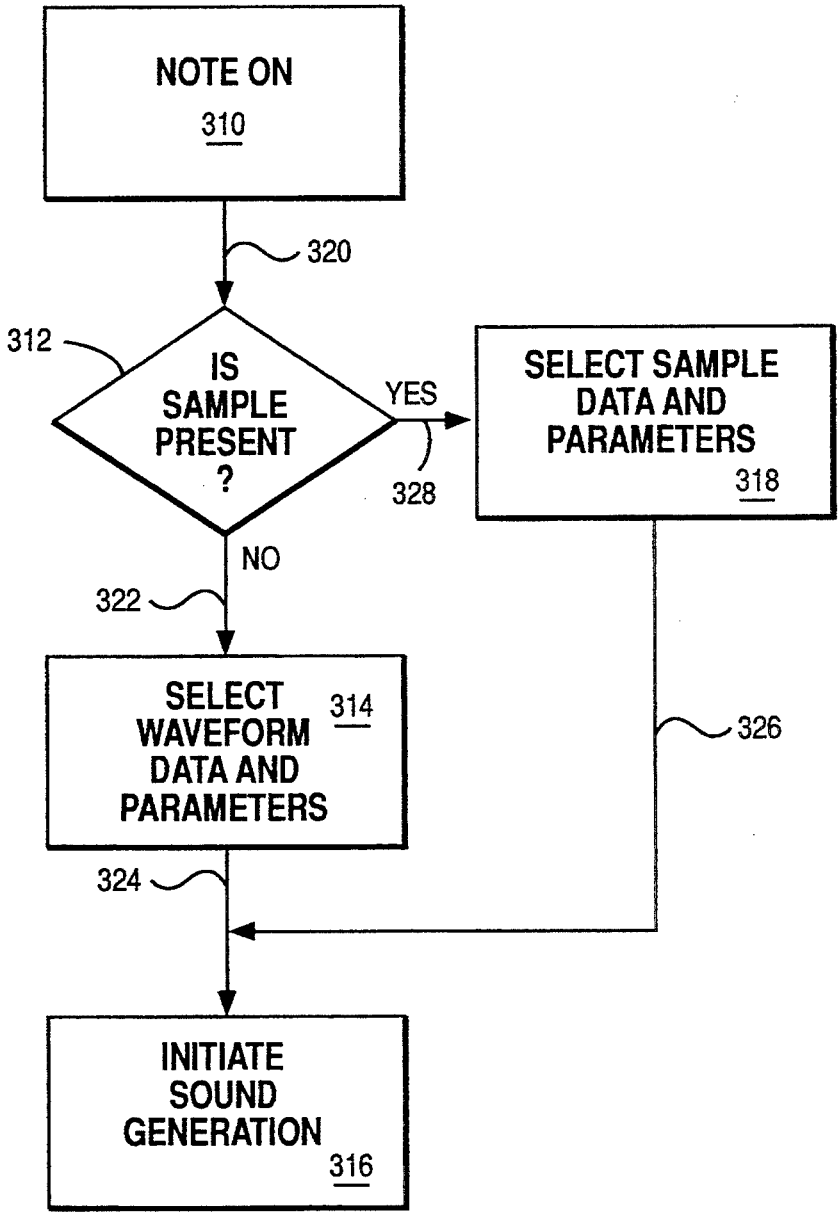
FIG. 8 is a flowchart of the method and apparatus of the present invention.

With reference now to FIG. 8, there is a simplified block diagram illustrating the operation of a desired software system controlling the system of FIG. 1 and FIG. 9 for achieving the hereinbefore stated objects of the invention. More particularly, this software is intended to execute with the processor 2 of FIG. 1 in a manner to be described. Specifically, as shown at block 310 the processor 2 will detect when a "note on" signal has been generated by the keyboard 4 as signified by a "note on" message 320. The processor 2 will then determine from the note on information 320 whether sample data 100 exists in the memory associated with the processor 2 corresponding to the desired note shown as decisional block 312. If such sample data is present, 328, the processor 2 will then retrieve the desired sample data 100 and associated parameters, 318, whereupon the process proceeds as shown by the path 326 to cause the system 1 to initiate the desired sound generation 316 based upon the sample data and parameters retrieved in block 318.

Returning back to block 312, if the processor 2, under software control, determines that such an appropriate sample data 100 defined by the note on information at 310 is not present in the sample data storage, (as indicated by path 322), the processor 2 will then proceed to effect the selection of appropriate waveform data and parameters, 314, from a respective corresponding waveform data storage 102, 104, etc, such waveform data being retrieved in correspondence with the particular desired note on message generated at block 310. This waveform data and parameters will then be utilized as shown at path 324, to initiate sound generation 316 in the manner that such sound generation was generated from block 318, the difference being that in this case the sound generated will be as a result of a waveform lookup table and associated wavetable synthesizer technique of FIG. 4, whereas if the appropriate acoustic digitized sample was present, 312, the sound thus generated at 316 would be effected by the system of FIGS. 1 and 9 in a manner consistent with the sampling synthesis technique described hereinbefore with reference to FIG. 2.

Referring now to FIG. 9, there is depicted a block diagram of an audio adapter which includes digital signal processor 154 which may be utilized to implement the method and apparatus of the present invention. As discussed above, this audio adapter may be simply implemented utilizing the IBM Audio Capture Playback Adapter (ACPA) which is commercially available. In such an implementation digital signal processor 154 is provided by utilizing a Texas Instruments TMS 320C25, or other suitable digital signal processor.

Still referring to FIG. 9, the I/O Bus 140 is a Micro Channel or PC I/O bus which allows the audio subsystem to communicate to a PS/2 or other PC computer. Using the I/O bus, the host computer passes information to the audio subsystem employing a common register 144, status register 146, address high byte counter 142, address low byte counter 158, data high byte bidirectional latch 148, and a data low byte bidirectional latch. 150.

The host command and host status registers are used by the host to issue commands and monitor the status of the audio subsystem. The address and data latches are used by the host to access the shred memory 152 which is an 8 K×16 bit fast static RAM on the audio subsystem. The shared memory 152 is the means for communication between the host (personal computer / PS/2) and the Digital Signal Processor (DSP) 154. This memory is shared in the sense that both the host computer and the DSP 154 can access it.

A memory arbiter, part of the control logic 166, prevents the host and the DSP from accessing the memory at the same time. The shared memory 152 can be divided so that part of the information is logic used to control the DSP 154. The DSP 154 has its own control registers 156 and status registers 156 for issuing commands and monitoring the status of other parts of the audio subsystem.

The audio subsystem contains another block of RAM referred to as the sample memory 162. The sample memory 130 is 2 K×16 bits static RAM which the DSP uses for outgoing sample signals to be played and incoming sample signals of digitized audio for transfer to the host computer for storage. The Digital to Analog Converter (DAC) 168 and the Analog to Digital Converter (ADC) 170 are interfaces between the digital world of the host computer and the audio subsystem and the analog world of sound. The DAC 168 gets digital samples from the sample memory 162, converts these samples to analog signals, and delivers these signals to the analog output section 172 along analog path 181A. The analog output section 172 conditions and sends the signals to the output connectors 188 for transmission via speakers 190 or headsets to the ears of a listener. The DAC 168 is multiplexed to give continuous operations to both outputs.

The ADC 170 is the counterpart of the DAC 168. The ADC 170 receives analog signals on lines 181B from the analog input section 174 (which received these signals from the input connectors 184, 186 (microphone, stereo player, mixer . . . )), converts these analog signals to digital samples, and stores them in the sample memory 162. The control logic 166 is a block of logic which among other tasks issues interrupts to the host computer after a DSP interrupt request, controls the input selection switch, and issues read, write, and enable strobes to the various latches and the Sample and Shared Memory.

For an overview of the functions of audio subsystem, consideration will now be given to how an analog signal is sampled and stored. The host computer informs the DSP 154 through the I/O Bus 10 that the audio adapter should digitize an analog signal. The DSP 154 uses its control registers 156 to enable the ADC 170. The ADC 170 digitizes the incoming signal and places the samples in the sample memory 162. The DSP 154 gets the samples from the sample memory 162 and transfers them to the shared memory 152. The DSP 154 then informs the host computer via the I.O bus 140 that digital samples are ready for the host to read. The host gets these samples over the I/O bus 140 and stores them in the host computer RAM or disk.

Many other events are occurring behind the scenes. The control logic 166 prevents the host computer and the DSP 154 from accessing the shared memory 152 at the same time. The control logic 166 also prevents the DSP 154 and the DAC 168 from accessing the sample memory 162 at the same time, controls the sampling of the analog signal, and performs other functions. The scenario described above is a continuous operation. While the host computer is reading digital samples from the shared memory 152, the DAC 168 is putting new data in the sample memory 162, and the DSP 154 is transferring data from the sample memory 162 to the shared memory 152.

Playing back the digitized audio works in generally the same way. The host computer informs the DSP 154 that the audio subsystem should play back digitized data. In the subject invention, the host computer gets code for controlling the DSP 154 and digital audio samples from its memory or disk and transfers them to the shared memory 152 through the I/O bus 140. The DSP 154, under the control of the code, takes the samples, converts the samples to integer representations of logarithmically scaled values under the control of the code, and places them in the sample memory 162. The DSP 154 then activates the DAC 140 which converts the digitized samples into audio signals. The audio play circuitry conditions the audio signals and places them on the output connectors. The playing back is also a continuous operation.

During continuous record and playback, while the DAC 168 and ADC 170 are operating, the DSP 154 transfers samples back and forth between sample and shared memory, and the host computer transfers samples back and forth over the I/O bus 140. Thus, the audio subsystem has the ability to play and record different sounds simultaneously. The reason that the host computer cannot access the sample memory 162 directly, rather than having the DSP 154 transfer the digitized data, is that the DSP 154 is processing the data before storing it in the sample memory 162. One aspect of the DSP processing is to convert the linear, integer representations of the sound information into logarithmically scaled, integer representation of the sound information for input to the DAC 168 for conversion into a true analog sound signal.

Analog paths 181, data bus 176, address bus 178, control bus 180 and analog paths 181A, 181B, 184–190 are shown with different lines for clarity in FIG. 9. Also conventional arbitration logic 160, 164 is further provided in a manner shown in the art for arbitrating information on the address and data buses respectively. Control logic 166 uses the logic 160, 164 to ensure the processor 2 and DSP 9 do not access either memory simultaneously to avoid memory deadlock or the like.

I claim:

1. A computerized method for producing audio signals comprising storing a first dataset corresponding to a first mode of producing of said audio signals;

generating a datastream defining parameters associated with said producing of said audio signals, including a specified mode from a group comprising said first mode and a second mode;

detecting automatically from said datastream if said specified mode is said first mode of said producing said audio signals; and producing said audio signals in said first mode with said datastream and said first dataset in response to said detecting said specified mode is said first mode.

2. The method of claim 1 further including storing of a second dataset corresponding to said second mode of producing said audio signals; and producing said audio signals in said second mode with said datastream and said second dataset in response to said detecting said specified mode is said second mode.

3. The method of claim 2 wherein said datastream is a MIDI datastream.

4. The method of claim 3 further comprising storing alternatively either said first dataset, or said second dataset as a program change having a unique indicator in said datastream associated therewith;

detecting from said datastream said program change;

determining from said detected program change if said first dataset or said second dataset has been stored; and producing said audio signals in said first mode with said first dataset after said determining when only said first dataset has been stored.

5. The method of claim 4 further including producing said audio signals in said second mode with said second dataset after said determining when only said second dataset has been stored.

6. The method of claim 1 wherein said first mode is wavetable synthesis mode.

7. The method of claim 6 wherein said second mode is sampling synthesis mode.

8. The method of claim 1 wherein said detecting and said producing are in real time.

9. The method of claim 1 wherein said detecting step is performed by a host system.

10. The method of claim 9 wherein said producing step is performed by a digital signal processor.

11. A computerized system for producing audio signals comprising means for storing a first dataset corresponding to a first mode of producing said audio signals;

means for generating a datastream defining parameters associated with said producing of said audio signals, including a specified said first mode;

means for detecting from said datastream if said first mode of said producing said audio signals is specified; and means for producing said audio signals in said first mode with said datastream and said first dataset in response to said detecting said specified first mode.

12. The apparatus of claim 11 further including means for storing a second dataset corresponding to a second mode of producing said audio signals; and means for producing said audio signals in said datastream and said second mode with said second dataset in response to said detecting said specified second mode.

13. The apparatus of claim 12 wherein said datastream is a MIDI datastream.

14. The apparatus of claim 13 further comprising means for storing alternatively either said first dataset or said second dataset as a program change having a unique indicator in said datastream associated therewith;

means for detecting from said datastream said program change;

means for determining from said detected program change if said first dataset or said second dataset has been stored; and means for producing said audio signals in said first mode with said first dataset after said determining when only said first dataset has been stored.

15. The apparatus of claim 14 further including means for producing said audio signals in said second mode with said second dataset after said determining when only said second dataset has been stored.

16. The apparatus of claim 11 wherein said first mode is wavetable synthesis mode.

17. The apparatus of claim 16 wherein said second mode is sampling synthesis mode.

18. The apparatus of claim 11 wherein said detecting and said producing are in real time.

19. The apparatus of claim 11 wherein said detecting step is performed by a host system.

20. The apparatus of claim 19 wherein said producing step is performed by a digital signal processor.

21. A computerized method for producing an audio signal in response to a datastream containing a program indicator; comprising storing a first program associated with a sound to be generated in a first mode;

storing a second program associated with a sound to be generated in a second mode;

monitoring said datastream;

selecting either said first program or said second program as a function of said program indicator in said monitored datastream; and producing said audio signal in response to data in said selected either first program or second program in a corresponding said first mode or said second mode dependent upon whether said first program or said second program is selected, respectively.

22. The method of claim 21 wherein said sound associated with said first program corresponds to a preselected sound type.

23. The method of claim 22 wherein said sound associated with said second program corresponds to the identical said preselected sound type associated with said first program.

24. The method of claim 23 wherein said second program is selected when said program indicator corresponds to said first program.

25. The method of claim 24 wherein said producing of said audio signal is in said second mode from said data in said second program in response to said selecting said second program.

26. The method of claim 22 wherein said first program is selected by default when a sound associated with said second program does not correspond to said preselected sound type associated with said first program.

27. The method of claim 24 wherein said producing of said audio signal is in said first mode from said data in said first program in response to said selecting said first program by default.

* * * * *